United States Patent [19]

Reid et al.

[11] Patent Number: 4,663,018

[45] Date of Patent: May 5, 1987

[54] METHOD FOR COKE RETARDANT DURING HYDROCARBON PROCESSING

[75] Inventors: Dwight K. Reid, David R. Foster, The Woodlands, both of Houston, Tex.

[73] Assignee: Betz Laboratories, Inc., Trevose, Pa.

[21] Appl. No.: 749,956

[22] Filed: Jun. 27, 1985

[51] Int. Cl.[4] ..... C10G 9/12; C10G 9/16

[52] U.S. Cl. ..... 208/48 R; 208/48 AA; 208/50; 208/131; 585/950

[58] Field of Search ..... 208/131, 48 R, 48 AA, 208/50; 585/950

[56] References Cited

U.S. PATENT DOCUMENTS

| | | | |
|---|---|---|---|
| 1,847,095 | 3/1932 | Mittasch | 208/48 R |
| 2,063,596 | 12/1936 | Feiler | 208/48 R |
| 2,354,163 | 7/1944 | Weizmann et al. | 208/48 R |
| 2,706,704 | 4/1955 | Squires, Jr. | 208/48 R |
| 3,261,878 | 7/1966 | Danz et al. | 208/127 |
| 3,531,394 | 9/1970 | Koszman | 208/48 |
| 3,948,759 | 4/1976 | King et al. | 208/131 |
| 4,119,552 | 10/1978 | Davis et al. | 252/49.6 |
| 4,295,955 | 10/1981 | Tu | 208/120 |
| 4,555,329 | 11/1985 | Reid | 208/48 R |

FOREIGN PATENT DOCUMENTS

| | | | |
|---|---|---|---|
| 614532 | 2/1961 | Canada | 208/47 |
| 275662 | 8/1928 | United Kingdom | 208/48 R |
| 296752 | 9/1928 | United Kingdom | 585/950 |

OTHER PUBLICATIONS

Boron and Refractory Borides, by Matkovich, Springer-Verlag, Berlin, Heidelberg, NY, 1977, 598-599.

Alfred Graf von Matuschka, Boronizing, Car Hanser Verlag, Munchen, Wein, 1980.

The Merck Index, 9th ed., p. 2987.

Dangerous Properties of Industrial Materials, 4th ed., Sax, p. 423.

The Condensed Chem. Dictionary, p. 295.

*Primary Examiner*—Andrew H. Metz

*Assistant Examiner*—Helane Myers

*Attorney, Agent, or Firm*—Alexander D. Ricci; Bruce E. Peacock

[57] ABSTRACT

The present invention is directed to a method of inhibiting the formation of coke during the elevated temperature processing of hydrocarbons. The method generally comprises adding to the hydrocarbon an effective amount of an ammonium borate, particularly ammonium biborate and ammonium pentaborate. Preferably, the ammonium borates are in a glycollic solvent or water.

20 Claims, No Drawings

METHOD FOR COKE RETARDANT DURING HYDROCARBON PROCESSING

BACKGROUND OF THE INVENTION

The present invention is directed to a method and composition for use in inhibiting the formation and deposition of coke on surfaces during the elevated temperature processing of hydrocarbons. Coke deposition is generally experienced when hydrocarbon liquids and vapors contact the hot metal surfaces of the processing equipment. While perhaps not entirely technically understood, because of the complex makeup of the hydrocarbons upon elevated temperatures and contact with hot metallic surfaces, the hydrocarbons undergo various changes through either chemical reactions and/or decomposition of various unstable components of the hydrocarbon. The undesired products in many instances include coke, polymerized products, deposited impurities and the like. Whatever the undesired product that may be formed, the result is the same, i.e., reduced economies of the process. If these deposits are allowed to remain unchecked, heat transfer, throughput and overall productivity are detrimentally effected. Moreover, downtime is likely to be encountered due to the necessity of either replacing and/or cleaning of the affected parts of the processing system.

While the formation and type of undesired products are dependent upon the hydrocarbon being processed and the conditions of the processing, it may generally be stated that such products can be produced at temperatures as low as 100° F. but are more prone to formation as the temperature of the processing system and the hydrocarbon reach levels of 600°-1400° F. At these temperatures, coke formation is likely to be produced regardless of the type hydrocarbon being charged. The type coke formed, i.e., amorphous, filamentous or pyrolytic, may vary somewhat; however, the probability of the formation of such is quite high.

As earlier stated the present invention is directed to methods and chemicals for use in the retardation of coke formation in the elevated temperature processes and also to the inhibition of deposition of the coke in the event it is actually formed.

The present invention is particularly effective in hydrocarbon processing systems where temperatures reach levels of 600° to 1400° F. where amorphous and filamentous coke are likely to be formed. Amorphous coke is generally produced in systems where temperatures are less than 850° F. This type coke generally is composed of low molecular weight polymers, has no definite structure and is sooty in nature. Above 850° F., filamentous coke is generally encountered. This type coke, as the name indicates, takes the form of filaments that appear in some cases like hollow tubes. As opposed to amorphous coke, filamentous coke is not sooty and is hard and graphitic in nature.

Amorphous and filamentous coke formation is customarily found in hydrocarbon processing systems such as delayed coking processes (temperature 900° to 1400° F.); platforming, catalytic reforming and magnaforming processes (900° F.); residue desulfurization processes (500° to 800° F.); hydrocracking processes (660°-1,100° F.), visbreaking processes (800°-1000° F.), cracking of chlorinated hydrocarbons, and other petrochemical intermediates of similar temperatures.

While various treatments have been proposed to eliminate or reduce filamentous coke formation at the 600° to 1300° F. temperatures, none have attained any great degree of success. In the book "Coke Formation on Metal Surfaces" by Albright and Baker, 1982, methods are described which utilize silicon and aluminum as pretreatments. In accordance with the procedure, the furnace tubes are pretreated with silicon and aluminum hours before introduction of the hydrocarbon feed stocks. With the use of silicon, furnace tubes are coated by the chemical vaporization of an alkoxysilane. While U.S. Pat. Nos. 4,105,540 and 4,116,812 are generally directed to fouling problems in general, the patents disclose the use of certain phosphate and phosphate and sulfur containing additives for use purportedly to reduce coke formation in addition to general foulants at high temperature processing conditions.

With respect to coke retardation, various efforts have been reported, namely:

1. French Pat. No. 2,202,930 (Chem. Abstracts Vol. 83, 30687K) is directed to tubular furnace cracking of hydrocarbons where molten oxides or salts of group III, IV or VIII metals (e.g., molten lead containing a mixture of $K_3VO_4$, $SiO_2$ and NiO) are added to a pretested charge of, for example, naphtha/steam at 932° F. This treatment is stated as having reduced deposit and coke formation in the cracking section of the furnace.

2. Starshov et al, *Izv Vyssh. Uchebn. Zaved., Neft GAZ,* 1977 (Chem. Abst. Vol. 87: 154474r) describes the pyrolysis of hydrocarbons in the presence of aqueous solutions of boric acid. Carbon deposits were minimized by this process.

3. Nikonov et al., U.S.S.R. 834,107, 1981; (Chem. Abst. 95:135651v) describes the pyrolytic production of olefins with peroxides present in a reactor, the internal surfaces of which have been pretreated with an aqueous alcoholic solution of boric acid. Coke formation is not mentioned in this patent since the function of the boric acid is to coat the inner surface of the reactor and thus decrease the scavenging of peroxide radicals by the reactor surface.

4. Starshov et al., *Neftekhimiya* 1979 (Chem. Abst: 92:8645j) describes the effect of certain elements including boron on coke formation during the pyrolysis of hydrocarbons to produce olefins.

5. U.S. Pat. No. 2,063,596 discusses in its prior art section the use of the problems associated with the processing of hydrocarbons in equipment whose metallic parts have been supplied with a metalloid. The general impression is that such has not been utilized successfully.

6. U.S. Pat. No. 1,847,095 in a somewhat ambiguous manner describes the use of metalloid compounds which are capable of yielding "volatile hydrogen" during the processing of hydrocarbons. The patent is silent with input to filamentous coke and the problems associated therewith and contains no disclosure or suggestion relative to the boron compounds which may be utilized during the processing of hydrocarbons for protection against filamentous coke formation.

7. Baker, R.T.K., Gas Chem. Nucl. React. Large Indust. Plant, Proc. Conf., 1980. Chem. Ab. Vol. 94, 1981, 94:8141h, is directed to the role of various additives e.g., $B_2O_3$ in effecting the growth rate of filamentous coke produced from the decomposition of $C_2H_2$ on Ni-Fe or Mo Catalysts. $B_2O_3$ is stated as being the only additive which failed to provide any significant reduction in the growth of the filaments.

DESCRIPTION OF THE INVENTION

Generally the invention entails the use of certain boron compounds, and compositions containing such, to inhibit the formation and deposition of coke on surfaces in contact with a hydrocarbon (either in liquid or gaseous form) having a temperature of 600°–1300° F. While the method is applicable to any system where coke is produced, at the specified range of temperature and where the coke formed has a tendency to deposit on a surface such as a surface of a cracking catalyst (for example; zeolite, platinum, cobalt molybdenum, etc.) the method is particularly effective where the surface is composed of a ferrous metal. Iron, as well as iron alloys such as low and high carbon steel, and nickel-chromium-iron alloys are customarily used for the production of hydrocarbon processing equipment such as furnaces, transmission lines, reactors, heat exchangers, separation columns, fractionators, and the like. As earlier indicated, and depending upon the process being practiced, certain alloys within a given system are prone to coke deposition and the consequences thereof.

The present inventor discovered that coking may be significantly reduced on the iron based and nickel-based surfaces of processing equipment by adding to the hydrocarbon feed stock or charge ammonium borates in particular ammonium pentaborates and biborates or in compositions.

The ammonium borates are effective when formulated with glycollic-type solvents, in particular ethylene glycol, propylene glycol and the like since they produce marketable solutions; aqueous solutions of the ammonium borates would also be effective.

The ammonium borate-type compounds may be dissolved in the water or the glycol carriers in any proportions, to produce a product which will provide the necessary amount of boron to any coke-formation prone environment to effectively eliminate or in the least minimize such. Coking in some instances, for example in delayed coking operations, is a significant problem and if left untreated will eventually shut the operation down. Accordingly it would be desirable to assure that any product used is either high in boron content or if not high in boron content is fed to the charge at high dosage rates. Accordingly, product formulation lends itself to great flexibility.

Generally the product can contain on a weight basis from about 1 to 50%, with the remainder being the carrier, for example ethylene glycol. To assure maintenance of the solution during storage and exposure to different and perhaps drastic temperature conditions or to protect the solution during transportation, various stabilizing agents may also be added to the formulation as well as any preservative which might be desirable.

Typical formulations would be as follows:

| Ingredient | Percentage by Weight Actual | Range | Preferred Range |
|---|---|---|---|
| Ammonium borate compound | 15% | 1–50 | — |
| Solvent | 85% | 50–1 | — |

The treatment dosages again are dependent upon the severity of the coking problem, location of such and of course the amount of boron based compound in the formulated product. Perhaps the best method of describing the treatment dosage would be based upon the actual amount of "boron" that should be added to the charge. Accordingly the amount of formulated product to be added to a charge should be such to provide 1 ppm to 8,000 ppm, and preferably 5 ppm to 1000 ppm, of boron to said hydrocarbon charge.

EXAMPLES

In order to establish the efficacy of the inventive concept various tests were conducted utilizing a number of hydrocarbon stock and feeds. The test procedure utilized was as follows:

In a glass reaction vessel, equipped with a metal stirring blade, a thermocouple, a reflux condenser, and a nichrome wire (0.51 mm thick and 95 mm long) designated Chromel A mounted between two brass rods 50 mm apart, were placed 500 grams of coker feedstock. A heating mantle was used to heat the feedstock to 450° F. with stirring. When this temperature was reached, the additive, if any, was added and the mixture stirred 30 minutes. Power (20 amps, 7.25–7.30 volts; this amount varying depending on the feedstock) was then applied to the wire. An adjustment was made to bring the current to 20.5 amps after 30 minutes. After the power was on for one (1) hour, the temperature of the reactor mixture was 650° F., which stayed at about this temperature for the next 23 hrs. At the end of 24 hours, the power was turned off and the reaction was cooled to 230° F., the wire removed, washed carefully and thoroughly with xylene, allowed to dry, and weighed.

The hydrocarbon stock used for the following testing is described as Coke Feedstock A.

EXAMPLE 1

With no additive, the average amount of coke on the wire was 115 mg.

EXAMPLE 2

Example 1 was repeated except that Product A composed of 15% by weight ammonium biborate [$(NH_4)_2B_4O_7$] and 85% by weight of ethylene glycol, was added as a coke inhibitor. Three separate tests were conducted.

The results of the test are set forth in the following table.

TABLE

| Test | Dosages as $(NH_4)_2B_4O_7$ | Weight Coke Deposited | % Protected |
|---|---|---|---|
| 1. Example 1 | None | 115 mg | — |
| 2. Example 2 Test 1 | 1500 ppm | 51 mg | 55.7 |
| 3. Example 2 Test 2 | 1500 ppm | 36.2 mg | 68.5 |
| 4. Example 2 Test 3 | 1500 ppm | 60.2 mg | 48.0 |
| | | | Avg. 57% |

$$\% \text{ Protector} = \frac{(\text{Wght coke deposited Ex. 1}) - (\text{wght of coke deposited with additive})}{(\text{Wght of coke deposited, Ex. 1})} \times 100\%$$

Having thus described my invention, what I claim is:

1. A process for inhibiting the formation and deposition of filamentous coke on the metallic surfaces in contact with a hydrocarbon having a temperature of 600° to 1400° F. which comprises adding to said hydrocarbon a sufficient amount for the purpose of an ammonium borate compound to provide from 1 to 8000 ppm of boron.

2. A method according to claim 1 wherein the ammonium borate compound is added to said hydrocarbon prior to its having a temperature of 600°-1400° F.

3. A method according to claim 2 wherein the hydrocarbon has a temperature of 850° to 1300° F.

4. A method according to claim 1 wherein the hydrocarbon has a temperature of 850° to 1300° F.

5. A method according to claim 1 wherein said ammonium borate compound is in a glycollic solvent.

6. A method according to claim 1 wherein said ammonium borate compound is selected from the group of ammonium biborate and ammonium pentaborate.

7. A method according to claim 5 wherein said ammonium borate compound is selected from the group of ammonium biborate and ammonium pentaborate.

8. A method according to claim 7 wherein the surfaces are ferrous metal surfaces.

9. A method according to claim 8 wherein the borate is ammonium biborate.

10. A method according to claim 9 wherein said borate is in a solvent selected from the group of ethylene glycol and propylene glycol.

11. In a method for producing coke wherein:

(i) a hydrocarbon is charged into a zone and brought to a temperature of from about 800°-1300° F. to remove and recover in a separation zone any products which are volatilized from and/or formed in said hydrocarbon when heated to said temperature, and (ii) the remainder of said hydrocarbon is transferred through transfer lines to a coke-forming area where such is coiled to form coke, and (iii) wherein undesired premature coke formation and deposition is normally experienced on the surfaces of said heating zone, products separation zone or transfer lines, the improvement being:

adding to said hydrocarbon an ammonium borate in an amount sufficient to provide from 1 to 8000 parts of boron per part of hydrocarbon to effectively inhibit the premature formation and deposition of the undesired filamentous coke in said heating zone, transfer lines and/or volatile or product separation zone.

12. A method according to claim 11, wherein the hydrocarbon charge is selected from the group of crude oils, shale oil, athabasca bitumen, gilsonite, coal tar pitch, asphalt, aromatic stocks and refractory stocks.

13. A method according to claim 12 wherein the heating zone, the separation zone and/or transfer lines are composed of a ferrous-metal.

14. A method according to claim 13 wherein the ammonium borate compound is selected from the group consisting of ammonium biborate and ammonium pentaborate.

15. A method according to claim 14 wherein the borate compound is in a glycollic solvent.

16. A method according to claim 11 wherein the ammonium borate is in a glycollic solvent.

17. A method according to claim 15 wherein the borate is added to said hydrocarbon charge in an amount to insure from about 1 to 8000 parts of boron per million parts of hydrocarbon charge.

18. A method according to claim 16 wherein the borate is added to said hydrocarbon charge in an amount to insure of from about 1 to 8000 parts of boron per million parts of hydrocarbon charge.

19. A method according to claim 18 wherein the borate is ammonium biborate.

20. A method according to claim 11 wherein the borate is ammonium biborate or ammonium-pentaborate.

* * * * *

UNITED STATES PATENT AND TRADEMARK OFFICE

CERTIFICATE OF CORRECTION

PATENT NO. : 4,663,018

DATED : May 5, 1987

INVENTOR(S) : Dwight K. Reid, David R. Foster

It is certified that error appears in the above-identified patent and that said Letters Patent is hereby corrected as shown below:

Column 3, line 47, after "50%", insert --- ammonium borate ---; line 61, change "50-1" to --- 50-99 ---.

Column 4, line 44, change "test" to --- tests ---; line 58/59, change "Protector" to --- Protected ---.

Claim 11, line 10, change "coiled" to --- cooled ---.

Claim 20, lines 2 - 3, change "ammonium-pentaborate" to --- ammonium pentaborate ---.

Signed and Sealed this

Twelfth Day of January, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,663,018

DATED : May 5, 1987

INVENTOR(S) : Dwight K. Reid, David R. Forester

It is certified that error appears in the above-identified patent and that said Letters Patent is hereby corrected as shown below: On the Title Page:

Section [75] Inventors: the name of the second inventor is amended to read --- David R. Forester ---.

Signed and Sealed this

Twenty-third Day of February, 1988

*Attest:*

DONALD J. QUIGG

*Attesting Officer*

*Commissioner of Patents and Trademarks*